US006763642B2

(12) United States Patent
Platt

(10) Patent No.: US 6,763,642 B2
(45) Date of Patent: Jul. 20, 2004

(54) GRID FOR A SUSPENDED CEILING

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 10/167,928

(22) Filed: Jun. 10, 2002

(65) Prior Publication Data

US 2003/0226322 A1 Dec. 11, 2003

(51) Int. Cl.[7] ..... E04B 2/00
(52) U.S. Cl. ..... 52/506.07; 52/506.06; 52/666; 52/668; 52/DIG. 8
(58) Field of Search ..... 52/506.01, 506.06, 52/506.07, 668, 666, 665, 664, DIG. 8

(56) References Cited

U.S. PATENT DOCUMENTS

| | | | |
|---|---|---|---|
| 4,785,603 | A | 11/1988 | Platt |
| 5,517,796 | A | 5/1996 | Koski et al. |
| 5,687,525 | A | 11/1997 | Koski et al. |
| 5,839,246 | A | 11/1998 | Ziegler et al. |
| 6,178,712 | B1 | 1/2001 | Sauer |

*Primary Examiner*—Carl D. Friedman
*Assistant Examiner*—Chi Q Nguyen
(74) *Attorney, Agent, or Firm*—Eugene Chovanes

(57) ABSTRACT

In a ceiling grid for a suspended ceiling having 2 ft.×2 ft. openings that support panels, a connection in the grid between a main beam and 4 ft. cross beam is made tighter than a connection in the grid between a 2 ft. cross beam and a 4 ft. cross beam. Both connections use the same connector, but with a different stop position on the connector.

4 Claims, 2 Drawing Sheets

GRID FOR A SUSPENDED CEILING

BACKGROUND OF THE INVENTION

1. Field of the Invention

This invention relates to a grid structure for a suspended ceiling and more particularly to the connections at the intersections of the grid.

2. Background Information

Prior Art Grid

Suspended ceilings having a grid structure of intersecting, connected, beams that support acoustical panels within rectangular enclosures formed by the grid, are used extensively in commercial and industrial buildings. Such a ceiling is shown in the U.S. patents referred to below.

The prior art grid involved in this invention has main beams extending along the length of the ceiling, parallel to one another. Such main beams are suspended from a structural ceiling by hanger wires. The main beams generally are four feet (4 ft.) apart, and are connected by 4 ft. cross beams extending between, and perpendicularly to, the main beams, at two foot (2 ft.) intervals along the main beams. The grid has additional cross beams, 2 ft. in length, extending between, and connected to, the middle of the 4 ft. cross beams. The result is a grid with 2 ft.×2 ft. square openings, into which correspondingly sized panels are laid.

The present invention relates to the connections at the intersections of the grid. Such connections are shown in U.S. Pat. Nos. 5,839,246, 6,178,712, and 5,517,796, incorporated herein by reference. A connector in such a connection is installed by a stab-in motion and has a stop that abuts the web of beam through which the connector is inserted. The invention involves the positioning of this stop.

Prior Art Installation of the Grid

In installing a prior art grid, a main beam section, generally twelve feet (12 ft.) in length, is assembled end to end with another main beam section to form a continuous main beam that extends lengthwise in the ceiling, parallel to one of the side walls. Each of the sections of the continuous main beam is suspended from the structural ceiling by hanger wires anchored in the structural ceiling.

Another continuous main beam is then assembled parallel to the first continuous main beam 4 ft. away from the first continuous main beam. Four foot (4 ft.) cross beams are then connected between the parallel continuous main beams perpendicularly to the main beams at two foot (2 ft.) intervals lengthwise along the main beams. Two foot (2 ft.) cross beams then are inserted between the 4 ft. cross beams at the middle thereof to form 2 ft. square openings to receive panels. Such construction is very well known. An example of such ceiling and beams is shown, for instance, in the '246 and '712 patents.

Prior Art Connections in the Grid

In the prior art connections, as seen for instance in the '712, '246 and '796 patents, opposing connectors in a connection are connected to each other, and are connected to the web of the intersecting beam through a slot in the web. They are assembled in a stab-in motion.

In a prior art ceiling grid having 2 ft. by 2 ft. openings, the connectors at the end of both the 2 ft. and 4 ft. cross beams are the same in a given ceiling, and involve a clip or tongue at the end of the cross beam that is inserted through an opening in the web of the main beam, in the case of a 4 ft. cross beam, or through an opening in the web of a 4 ft. cross beam, in the case of a connector on the end of a 2 ft. cross beam. Again, examples of such connectors are shown in the above referred to '712, '246 and '796 patents.

The 4 ft. and 2 ft. cross beams with their connectors, serve, in the case of the 4 ft. beams, to space the beams to which they are connected, from one another, in the plane of the ceiling, and, in the case of both the 4 ft. and 2 ft. cross beams, to provide a horizontal support for the acoustical panels inserted in the openings between the beams.

In a completed assembly of beams, a grid with defined 2 ft. by 2 ft. openings to receive panels, is formed. The main beams are desirably positioned substantially parallel to one another at a relatively precise 4 ft. distance, with desirably relatively tight connections, since any error in spacing because of the 4 ft. cross beams becomes cumulative across the ceiling, so that no longer is the grid a pattern of precise 2×2 ft. square openings in the final assembly.

Tight, tighter, and tightness as defined herein refers to the possible lateral motion of the web that can occur in a connection. Less lateral motion of the web can occur in a tighter connection than in a looser connection.

The prior art connectors of the type referred to herein are, in a connection, not only connected to a web of a beam in an intersection, but connected to each other. The present invention has no effect on the tightness or looseness with which the connectors in a connection are connected to one another, but only has an effect on the possible lateral, or sideways, movement of the web of the beam through which the connectors pass. Again, reference is made to the '246, '712 and '796 patents which explain in detail the above.

Prior Art Installation of the Connections in a Grid

Although relatively tight connections between the 4 ft. cross beams and main beams are desirable in a grid in the spacing of the main beams from one another to avoid a cumulative error across a ceiling, as explained above, relatively loose connections are desirable in the connections between the 4 ft. cross beams. In the installation of first the main beams, and then the 4 ft. cross beams, fixed 2 ft.×4 ft. openings are created. It is only necessary for the 2 ft. cross beams to be connected to the 4 ft. beams in order to support the inserted panels, and not to space the 4 ft. cross beams in the plane of the ceiling.

There is not only no need for the 2 ft. cross beams to space the 4 ft. beams in the plane of the ceiling, but a need that no such spacing occur. Should, for instance, the 2 ft. cross beams be slightly too long or slightly too short, or if the spacing between openings in the main beams be slightly off from 2 ft., by using a relatively tight connection, the 2 ft. cross beams would bow the 4 ft. cross beams when connected in a given 2 ft.×4 ft. opening during the construction of the ceiling. This bowing would become cumulative down the row of 4 ft. cross beams extending between a pair of parallel main beams. By creating a relatively looser connection between the 4 ft. cross beams and 2 ft. cross beams, the 2 ft. cross beams are allowed to in effect float longitudinally in the connection, without bowing the 4 ft. cross beams, whereby any errors in the manufacturing of the 2 ft. cross beams, or the spacing of the 4 ft. cross beams down the length of the main beams, can be tolerated.

Thus, there is a conflict in the requirements for tightness or looseness in the connections in a grid ceiling having 2 ft. by 2 ft. openings.

A solution to the problem would appear to be the use of two different kinds of connectors; a loose type and a tight type. The prior art, however, uses the same connector on both the 4 ft. and 2 ft. sections since manufacturers need the relative simplicity of producing, storing, and selling one type of cross beam connector in a given ceiling, and installers need to avoid confusion in the installation which could arise from using different types of connectors.

The prior art has settled on using the more loose standard in all the connections in a ceiling grid having 2 ft.×2 ft. openings, since such standard can be accommodated in both the connection at the main beam, and the connection of the 2 ft. cross beam to the 4 ft. cross beam, even though the looser standard may give rise to displacement of the main beams. The tighter standard would create bowing of the 4 ft. cross beams, which would become cumulative.

SUMMARY OF THE PRESENT INVENTION

The present invention provides for relatively tighter main beam connections at the end of the 4 ft. sections with relatively looser connections at the end of the 2 ft. cross beams, to the 4 ft. cross beams, with the same connector. This is accomplished by slightly moving the stop, in prior art connectors of the stab-in type shown in the '246, '712 and '796 patents, a distance, for instance, of 0.005"±0.001", closer to the web of the beam to which the connector is secured, in a connection to a main beam, than in a cross beam connection to a 4 ft. cross beam. Since a connector is inserted from each side of the web, the tightness in a main beam connection is twice increased, for instance, by a greater tightness of 0.010"±0.002" in the above example, over the tightness of the connection of a 2 ft. cross beam to a 4 ft. cross beam. In a long stretch, such increased tightness at each main beam connection avoids a substantial drift in the spacing of the main beams.

In making the main beam connection tighter, the present invention utilizes the ability of the main beam to move relative to one another during the installation of the 4 ft. cross beams.

In the present invention, wherein connections at the end of the 4 ft. sections are made tighter than the connections at the 2 ft. sections, the connectors themselves are of the same configurations, and are manufactured with the same machine tools, presses, and dies in the same process. It is merely necessary to alter the stop dimensions in the dies that stamp out the connectors, to achieve the desired stop positions set forth above. The connectors are installed in the same way.

DETAILED DESCRIPTION OF THE INVENTION

Figure 1:
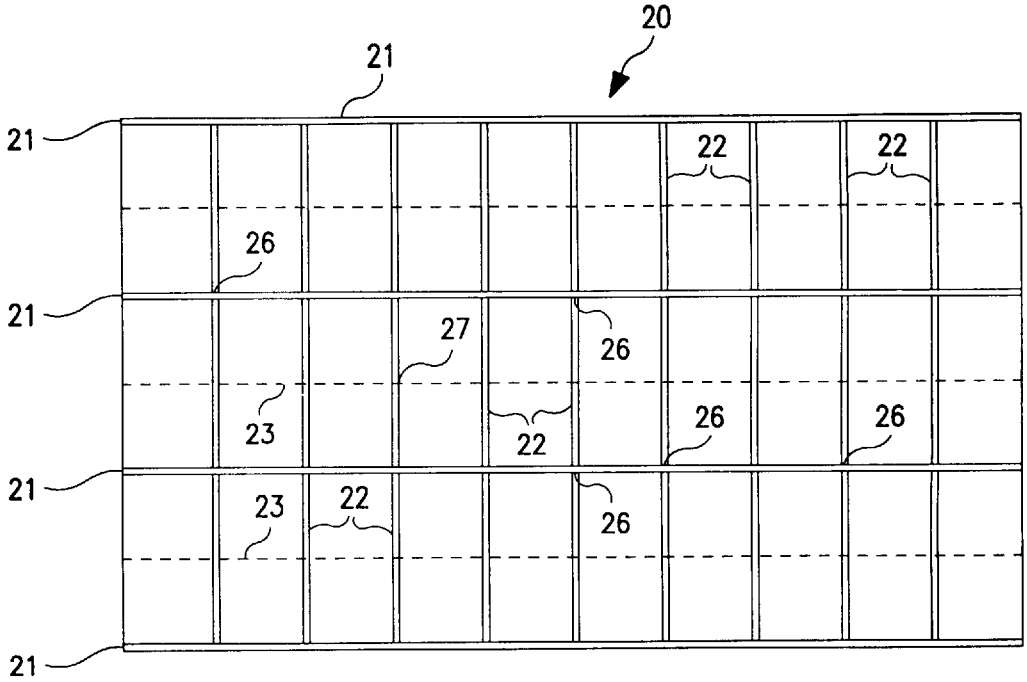
FIG. 1 is a schematic view of a ceiling grid, taken from below the ceiling.

FIG. 1 is a schematic view taken from below of a prior art ceiling grid 20 having main beams 21 running continuously from left to right in the drawing. The main beams 21, 4 ft. cross beams 22, and 2 ft. cross beams 23, form 2 ft.×2 ft. openings to receive laid-in acoustical panels. Main beams 21 and 4 ft. cross beams 22 are shown by double solid lines, and 2 ft. cross beams 23 by dashed lines, it being understood that when an actual grid is viewed from below, one would see the bottom of the flanges of the beams, which would all appear alike. Portions of such prior art ceilings are seen in the '246 and '712 patents. The beams are of inverted T-cross sections, with panels laid on the flanges of the T.

Figure 3:
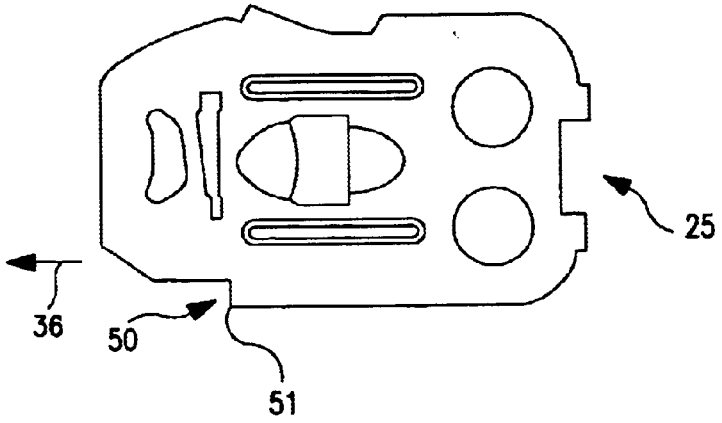
FIG. 3 PRIOR ART
FIG. 3 is a front view of a prior art connector that continues to be used in the present invention only on the ends of a 2 ft. cross beam.
Figure 4:
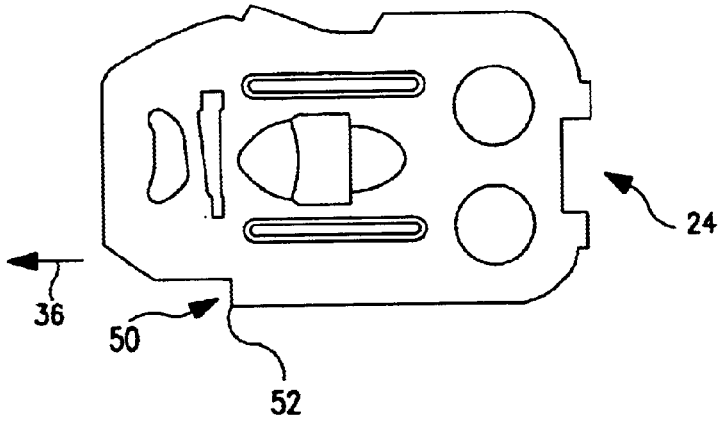
FIG. 4 PRIOR ART
FIG. 4 is a front view of the connector of FIG. 3, with the stop 50 moved forward on the connector a distance of 0.005"±0.001".
Figure 5:
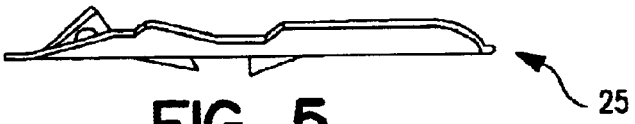
FIG. 5 PRIOR ART
FIG. 5 is a top view of the connector of FIG. 3.

Connections 26 and 27 connect the beams together at intersections. The 4 ft. cross beams 23 are connected to each other and to the main beams at connection 26. The 2 ft. cross beams are connected to each other, and to the 4 ft. cross beams at connection 27. In forming the connections 26 and 27, connectors 24 on the ends of the 4 ft. cross beams 22 extend through a slot in the web of main beam 21, and connectors 25 on the ends of the 2 ft. cross beams 23 extend through slots in the web of the 4 ft. cross beams 22. Such connections and connectors are of the prior art type disclosed in the '246, '712, and '796 patents, and as seen in FIGS. 3 through 5 of the present drawings.

Figure 2:
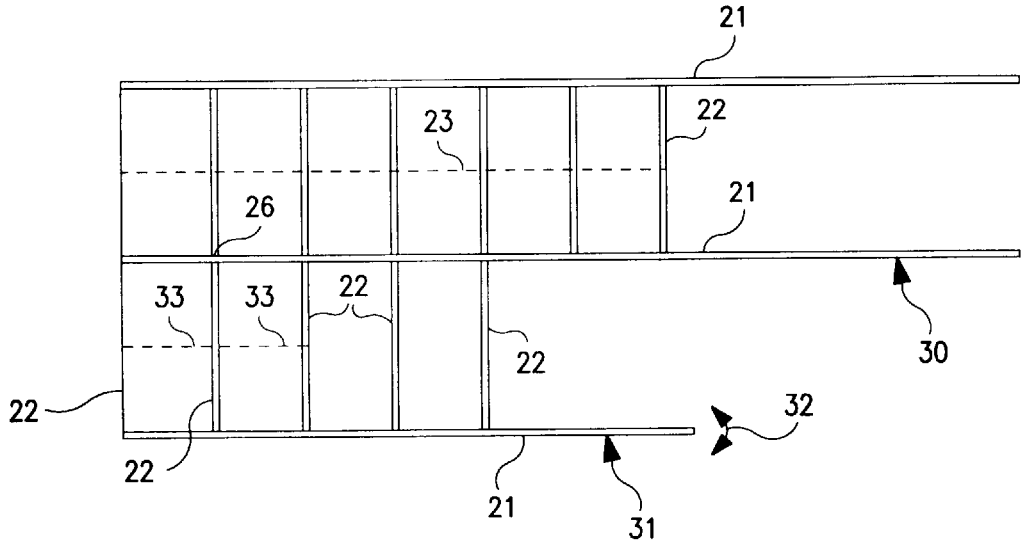
FIG. 2 is a schematic view of a ceiling grid being installed, taken from below.

In the installation of a prior art ceiling, a main beam 21, as seen schematically in FIG. 2, is suspended from a structural ceiling, by wires, as seen for instance in the '712 patent, at location 30. Another main beam is then hung parallel to the main beam 21 at 30, at location 31. 4 ft. cross beams 22 are then inserted between the main beams 21 at 30 and 31 by a stabbing motion, as disclosed in the '246 and '712 patents.

The main beam 21 at 31 is free to move somewhat as shown at 32, to accommodate this stabbing motion, since the beam 21 at 31 is not yet locked in place in the grid.

2 ft. beams 23 are then inserted as at 33, again by a stabbing motion, between the 4 ft. beams 22. The 4 ft. beams are not free to swing or move, as was the main beam 21, at 31, as earlier described, in the assembly of the grid.

The above process continues until the ceiling grid 20 is assembled.

The invention will be described with reference to the connectors disclosed in the '712, '246 and '796 patents, as well as FIGS. 3 through 5. These patents, and the present drawings, disclose connectors having a stop at the bottom of the connector. The stop in '246 patent is referred to by the reference character 76, and the stop in the '712 patent is referred to by the reference numeral 8 on one connector in the connection, and 8' on the opposing connector in the connection. The stop in the '896 patent is identified by the reference character 31. In FIGS. 3 and 4 of the present drawings, the stop is referred to by the reference character 50. When the connection is assembled through a slot on the main runner, as well known in the prior art, and as seen in FIG. 7 of the '246 patent, FIG. 3 of the '713 patent, and FIG. 8 of the '796 patent, these stops will straddle the web of the main runner, and abut the main runner. The connectors are secured in the connections as described.

The stops 76 in the '246 patent, 8 and 8' in the '712 patent, and 31 in the '796 patent, as does the stop 50 in present FIGS. 3 and 4, straddle the web of the beam with which the connectors are making the connection. In the case of the patents referred to above, the slot is in the web of a main beam. However, in the present invention, such beam with a slot could also be a 4 ft. cross beam, as well known in the prior art, and as explained above.

The invention involves the different placement of stop 50 as shown in FIGS. 3 and 4 of the drawings in this specification. Prior art stop 50 corresponds to the stops referred to above in the '246, '712 and '796 patents, with the remaining prior art features of the connector of FIG. 3 corresponding to those shown in those patents. The connector of FIG. 3 is secured to the ends of the 2 ft. cross beams and the connector of FIG. 4 is secured to the ends of the 4 ft. cross beams. The connectors of FIGS. 3 and 4 are exactly the same except for the position of stop 50 as will be explained.

The connectors shown in FIGS. 3 and 4 are of the stab-in type and are substantially the same as those shown and described in the '246 and '712 patents. Reference is made to these two patents for a detailed description of the construction and operations of the connectors shown in FIGS. 3 and 4.

The '246 patent has additional features directed to the relieving expansion from a fire. Such features form no part of the present invention.

The connector 25 shown in FIG. 3 has the prior art stop in the position used in the past on both the 4 ft. cross beams that connect to the main beam, and 2 ft. cross beams that connect to the 4 ft. cross beams. The stop 50 is at the prior art position designated 51. In the present invention, the prior art stop of FIG. 3, with the stop at the prior art position, will continue to be used at ends of the 2 ft. cross beam. The same relatively loose connections that now exist between the 2 ft. cross beams and 4 ft. cross beams, will continue.

In the present invention, however, the stop 50 in the connector 24, as seen in FIG. 4, will be extended 0.005"±0.001", to the position designated 52, toward the end of the connector that first enters the slot in the web of the beam through which the connector is inserted. In FIGS. 3 and 4, such entrance end is seen by arrow 36 that shows the direction of insertion of the connector into the web during installation.

When a ceiling grid having 2 ft.×2 ft. openings, as described above, is installed using the connectors of FIGS. 3 and 4 in the runner shown in the '246 and '712 patents, the connection at the main beams will be 0.010"±0.002" tighter. Assembled prior art connections are shown in FIG. 1 of the '246 patent and FIG. 3 of the '712 patent. The stops on each side of the web will contribute to the increased tightness. By so tightening up each such connection occurring at 2 ft. intervals along a continuous main beam, any substantial cumulative deviation from the 4 ft. space between main beams across a ceiling, in the grid pattern, is prevented. While holding the continuous main beams to increased accuracy, the same connector, but with a different stop position, is used on the 2 ft. sections to provide a looser connection that continues to meet the requirements of relative looseness or float without any bowing of the 4 ft. beams in the plane of the ceiling.

Both the connectors shown in FIGS. 3 and 4 continue to be manufactured in the same way, with the same machinery, and continued to be attached to the end of the cross beams in the same prior art way, as described in the '246 and '712 patent. The slots in the main beams and 4 ft. cross beams remain the same.

Installation of the grid in the field takes place in the same way with the installer required to make no deviation from their prior art practice.

Disassembly of the connections, when desired, are again made in accordance with the disclosure in the '246 and '712 patents.

What is claimed is:

1. In a group of main beams, 4 ft. cross beams, and 2 ft. cross beams, capable of being assembled in the field into a ceiling grid forming 2 ft. by 2 ft. square openings, the assembled grid having:

(a) connections between a main beam and two 4 ft. cross beams, and (b) connections between a 4 ft. cross beam and two 2 ft. cross beams;

wherein both connections in (a) and (b) are made with connectors of the same design;

the improvement comprising in combination, a tighter (a) than (b) connection, and a looser (b) than (a) connection, to form a more precise 2 ft.×2 ft. opening in the assembled grid, wherein the position of a stop on a connector in the (a) connection and in the (b) connection determines whether the connection is tighter or looser.

2. The improvement of claim 1 wherein the position of the stop on the connector in connection (a) is closer to the end of the connector than the position of the stop on the connector in connection (b).

3. The improvement of claim 2 wherein the distance between the position of the stop on the connector in connection (a) and the position of the stop on the connector in connection (b) is about 0.005"±0.001".

4. The improvement in any of the above claims wherein the connections are formed by a stab-in motion of the connector.

* * * * *